US008098872B2

(12) United States Patent
Chang

(10) Patent No.: US 8,098,872 B2
(45) Date of Patent: Jan. 17, 2012

(54) HEADPHONE

(76) Inventor: Chi-Tsan Chang, Taipei (TW)

( * ) Notice: Subject to any disclaimer, the term of this patent is extended or adjusted under 35 U.S.C. 154(b) by 380 days.

(21) Appl. No.: 12/458,305

(22) Filed: Jul. 8, 2009

(65) Prior Publication Data

US 2011/0007928 A1 Jan. 13, 2011

(51) Int. Cl.
*H04R 25/00* (2006.01)

(52) U.S. Cl. ..... 381/371; 381/370; 381/374

(58) Field of Classification Search ..... 381/309, 381/338, 370, 371, 372, 374, 376, 380, 381, 381/74; 181/129; 379/430
See application file for complete search history.

(56) References Cited

U.S. PATENT DOCUMENTS 7,340,071 B2 * 3/2008 Huang ..... 381/309
7,463,748 B2 * 12/2008 Yang ..... 381/370
2003/0103637 A1 * 6/2003 Huang ..... 381/309
* cited by examiner

*Primary Examiner* — Huyen Le
(74) *Attorney, Agent, or Firm* — Rosenberg, Klein & Lee

(57) ABSTRACT

In a headphone having a headband and two speaker units respectively pivotally mounted on the two distal ends of the headband, each speaker unit includes a speaker eccentrically positioned therein, an ear cushion covered on the front side of the speaker and having an eccentric opening, and a soft front covering the ear cushion and defining with the eccentric opening a sound chamber for enhancing the sound produced by the speaker and having sound holes for output of sound from the sound chamber to the user's ear.

7 Claims, 5 Drawing Sheets

HEADPHONE

BACKGROUND OF THE INVENTION

1. Field of the Invention

The present invention relates to headphones and more particularly, to an improved structure of headphone that has the speaker of each of the two speaker units thereof disposed at an eccentric location and a sound chamber defined in each speaker unit in axial alignment with the speaker for enhancing the sound produced by the respective speaker.

2. Description of the Related Art

A conventional headphone, as shown in FIGS. 6 and 7, generally comprises a headband 3 and two speaker units 4 respectively pivotally mounted on the two distal ends of the headband 3. Each speaker unit 4 comprises a speaker 41, an annular earphone cushion 42 located on the front side of the speaker 41 and defining a center opening 43. As the speaker 41 is disposed in the speaker unit 4 at the center, the speaker 41 is not kept in axial alignment with the user's ear accurately when the ear cushion 42 is attached to the user's ear, the sound produced by the speaker 41 will be disturbed in the center opening 43 before entering the user's ear, thereby lowering the sound quality.

SUMMARY OF THE INVENTION

The present invention has been accomplished under the circumstances in view. It is one object of the present invention to provide a headphone, which prevents diffusion of the sounds produced by the speakers thereof. It is another object of the present invention to provide a headphone, which enhances the sound quality.

To achieve these and other objects of the present invention, a headphone comprises a headband and two speaker units respectively pivotally mounted on the two distal ends of the headband. Each speaker unit comprises a speaker eccentrically positioned therein, an ear cushion covered on the front side of the speaker and having an eccentric opening, and a soft front covering the ear cushion and defining with the eccentric opening a sound chamber for enhancing the sound produced by the speaker and having sound holes for output of the sound from the sound chamber to the user's ear.

Each speaker further comprises a speaker holder holding the speaker, a locating ring fastened to the front side of the speaker holder to hold the ear cushion, and a back cover covered on the back side of the speaker holder opposite to the locating ring. The speaker holder has a plurality of retaining rods. The locating ring has a plurality of mounting slots for the passing of the retaining rods of the speaker holder, and a plurality of elastic retaining members respectively disposed at two opposite sides of each of the mounting slots and adapted for securing the retaining rods to the mounting slots. Thus, the ear cushion can be conveniently detached from the speaker holder for a replacement.

DETAILED DESCRIPTION OF THE PREFERRED EMBODIMENT

Figure 1:
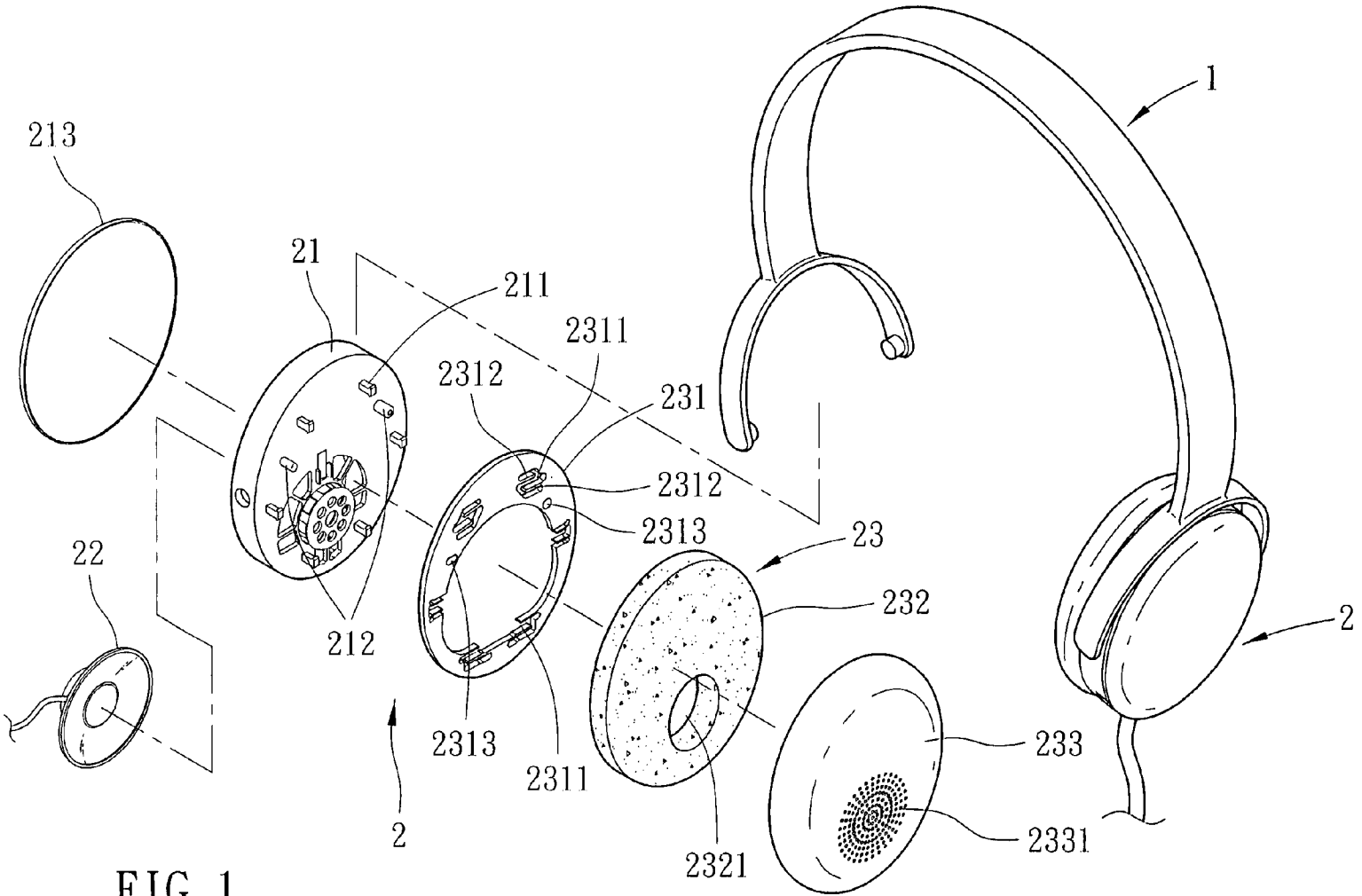
FIG. 1 is an exploded view of a headphone in accordance with a first embodiment of the present invention.
Figure 2:
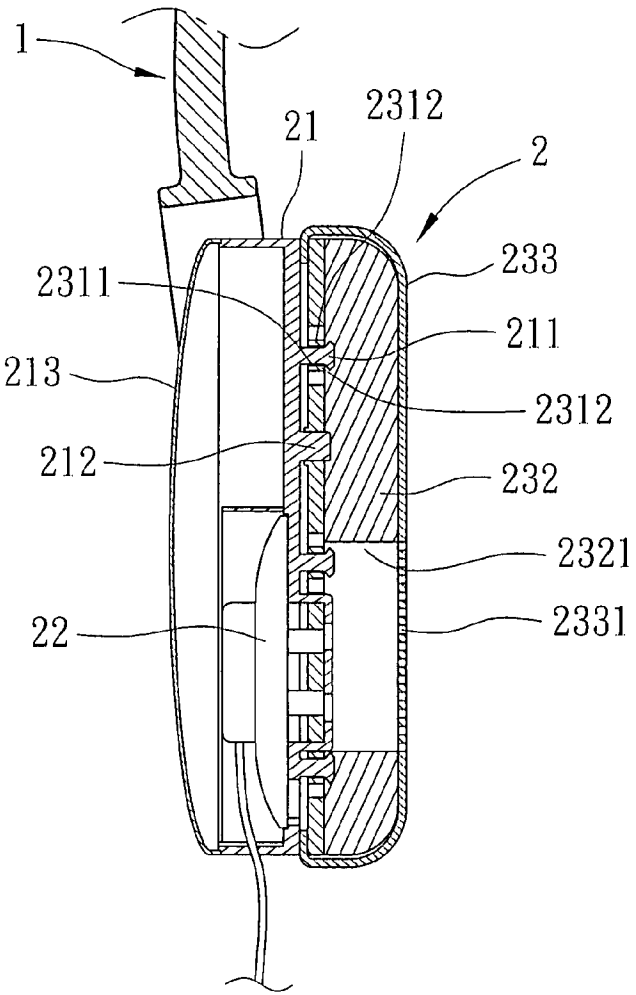
FIG. 2 is a sectional assembly view of a part of the first embodiment of the present invention, showing the structure of one speaker unit.
Figure 6:
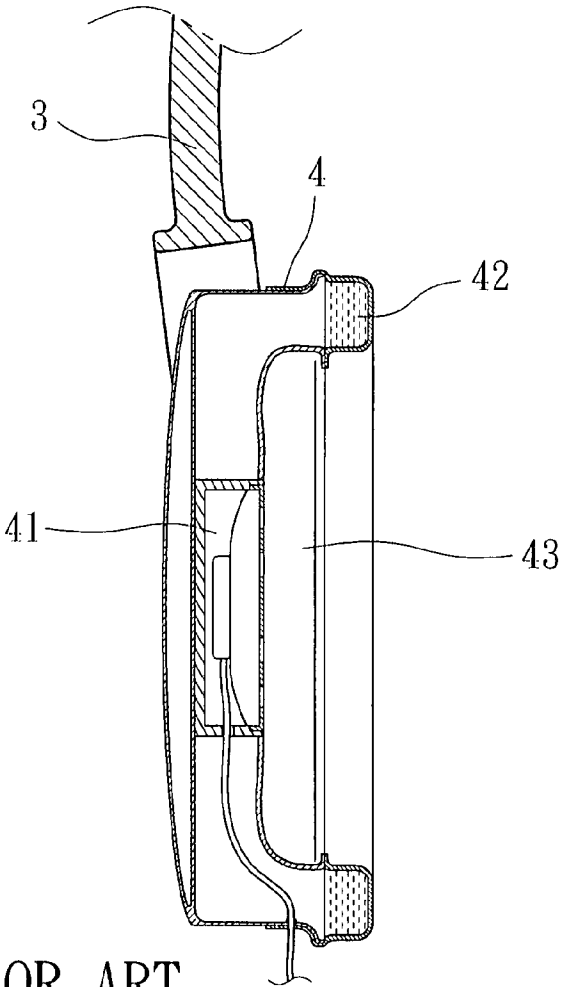
PRIOR ART FIG. 6
FIG. 6 is a sectional view of a part of a headphone according to the prior art.
Figure 3:
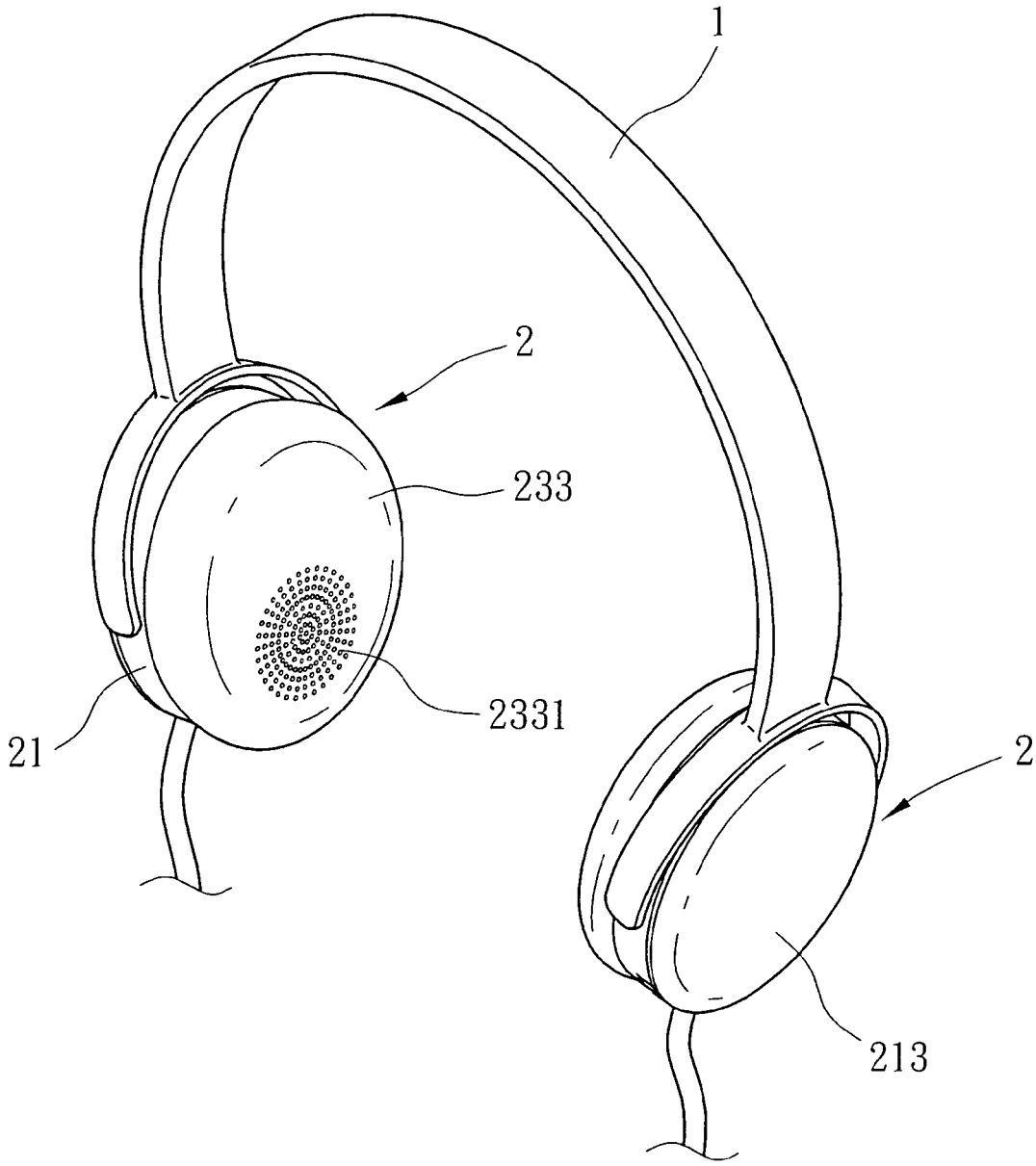
FIG. 3 is an elevational view of the headphone in accordance with the first embodiment of the present invention.

Referring to FIGS. 1-3, a headphone in accordance with a first embodiment of the present invention is shown comprising a smoothly arched headband 1, and two speaker units 2 respectively pivotally mounted on the two distal ends of the smoothly arched headband 1 and securable to the ears of a person by the headband 1.

Each speaker unit 2 comprises a speaker holder 21, which has a plurality of retaining rods 211 and a plurality of locating pins 212 perpendicularly extended from the front side thereof and spaced along the circular border thereof, a speaker 22 carried on the speaker holder 21 at an eccentric location, a back cover 213 covered on the back side of the speaker holder 21, a locating ring 231, which is attached to the front side of the speaker holder 21 and has a plurality of mounting slots 2311 respectively coupled to the retaining rods 211 of the speaker holder 21, a plurality of elastic retaining members 2312 respectively disposed at two opposite sides of each of the mounting slots 2311 for securing the respective retaining rods 211 after insertion of the retaining rods 211 into the respective mounting slots 2311 and a plurality of locating holes 2313 respectively fastened to the locating pins 212 of the speaker holder 21, an ear cushion 23, which comprises an ear cushion body 232 made of a sound absorbing material, for example, sound absorbing acoustic foam and affixed to the locating ring 231 and covered over the front side of the speaker holder 21 and having an eccentric opening 2321 corresponding to the speaker 22 for forming a sound chamber, and a soft front covering 233, which is fixedly fastened to the locating ring 231 and covered over the ear cushion 23 to have the eccentric opening 2321 work as a sound chamber and has small sound holes 2331 corresponding to the eccentric opening 2321 for output of sound waves from the speaker 22. The mounting arrangement between the speaker holder 21 and the locating ring 231 enables the user to detach the ear cushion 23 from the speaker holder 21 for a replacement conveniently.

During application of the headphone, the sound chamber which is formed of the eccentric opening 2321 of the ear cushion 23 and the soft front covering 233 enhances the sound produced by the speaker 22.

Figure 4:
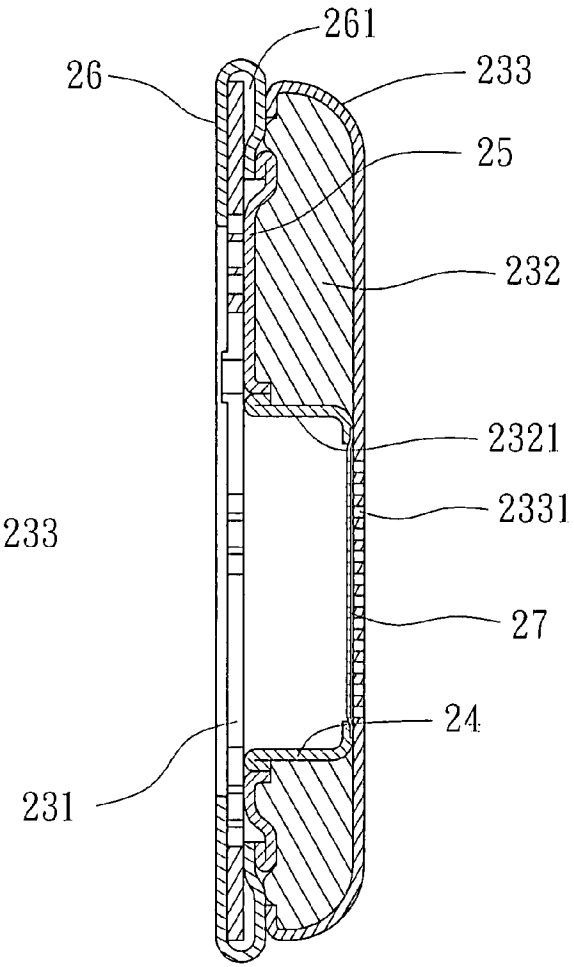
FIG. 4 is a sectional assembly view of a speaker unit for headphone in accordance with a second embodiment of the present invention.
Figure 5:
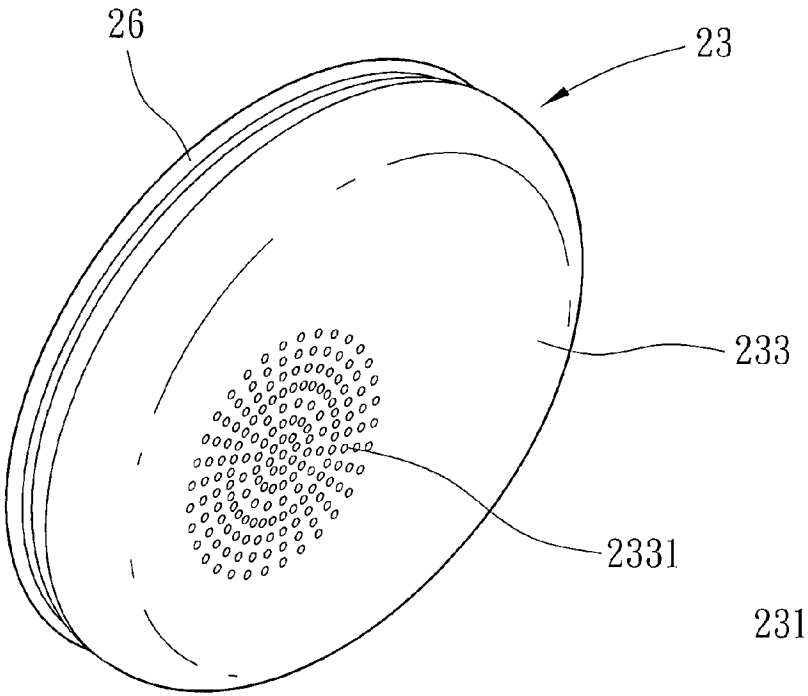
FIG. 5 is an elevational view of one speaker unit for headphone in accordance with the second embodiment of the present invention.
Figure 7:
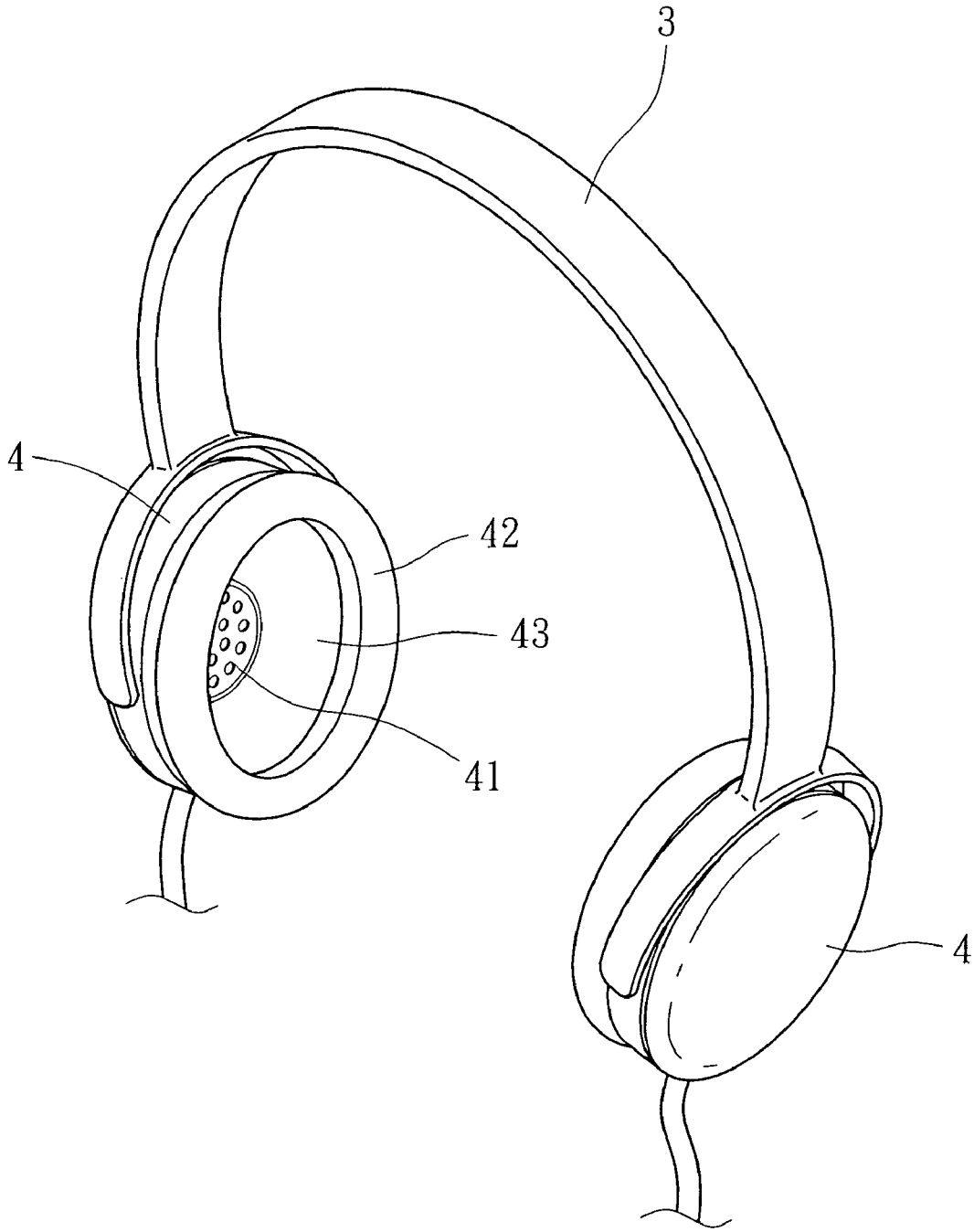
PRIOR ART FIG. 7
FIG. 7 is an elevational view of the headphone according to the prior art.

FIGS. 4 and 5 show a headphone in accordance with a second embodiment of the present invention. According to this second embodiment, the back side of the ear cushion 23 and the border of the eccentric opening 2321 of the ear cushion 23 are respectively covered with coverings 24 and 25; a rim member 26 having a mounting groove 261 is capped on the periphery of the locating ring 231; a mesh layer 27 is fastened to the back side of the soft front covering 233 and covered over the eccentric opening 2321 to prevent entering of external objects into the inside of the speaker unit 2.

Although particular embodiments of the invention have been described in detail for purposes of illustration, various modifications and enhancements may be made without departing from the spirit and scope of the invention. Accordingly, the invention is not to be limited except as by the appended claims.

What the invention claimed is:

1. A headphone, comprising:

a headband attachable to the head of a person using the headphone; and two speaker units respectively pivotally mounted on two distal ends of said headband and securable to the ears of the person using the headphone;

wherein: each said speaker unit comprising:

a speaker positioned therein at an eccentric location for producing sound;

an ear cushion covered on a front side of said speaker and fitting over the user's ear, said ear cushion having an eccentric opening; and a soft front covering said ear cushion and defining with said eccentric opening a sound chamber for enhancing sound produced by said speaker, said soft front covering having sound holes for output of sound from said sound chamber to the user's ear.

2. The headphone as claimed in claim 1, wherein each said speaker further comprises:

a speaker holder holding said speaker;

a locating ring fastened to a front side of said speaker holder to hold said ear cushion; and a back cover covered on a back side of said speaker holder opposite to said locating ring.

3. The headphone as claimed in claim 2, wherein said speaker holder has a plurality of retaining rods; said locating ring has a plurality of mounting slots for the passing of the retaining rods of said speaker holder and a plurality of elastic retaining members respectively disposed at two opposite sides of each of said mounting slots and adapted for securing said retaining rods to said mounting slots.

4. The headphone as claimed in claim 2, wherein said speaker holder has a plurality of locating pins; said locating ring has a plurality of locating holes respectively coupled to the locating pins of said speaker holder.

5. The headphone as claimed in claim 2, wherein said ear cushion has an ear cushion body made of a sound absorbing material, said ear cushion body having said eccentric opening defined therein.

6. The headphone as claimed in claim 2, wherein each said speaker unit further comprises a first inner covering mounted inside said ear cushion and covered over the border of said eccentric opening, a second inner covering covered on a back side of said ear cushion and attached to said locating ring, and a rim member capped on the periphery of said locating ring, said rim member having a mounting groove fitting over the periphery of said locating ring.

7. The headphone as claimed in claim 1, wherein each said speaker unit further comprises a mesh layer fastened to a back side of said soft front covering and covered over said eccentric opening.

* * * * *